US009468971B2

(12) United States Patent
Yamagata et al.

(10) Patent No.: US 9,468,971 B2
(45) Date of Patent: Oct. 18, 2016

(54) PRESS FORMING METHOD

(71) Applicant: NIPPON STEEL & SUMITOMO METAL CORPORATION, Tokyo (JP)

(72) Inventors: Mitsuharu Yamagata, Tokyo (JP); Shuji Yamamoto, Tokyo (JP); Yasuhiro Wada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/650,593

(22) PCT Filed: Dec. 26, 2013

(86) PCT No.: PCT/JP2013/084846

§ 371 (c)(1),
(2) Date: Jun. 9, 2015

(87) PCT Pub. No.: WO2014/109240

PCT Pub. Date: Jul. 17, 2014

(65) Prior Publication Data

US 2015/0314357 A1 Nov. 5, 2015

(30) Foreign Application Priority Data

Jan. 9, 2013 (JP) ..... 2013-001834
Jan. 9, 2013 (JP) ..... 2013-001835

(51) Int. Cl.
*B21K 23/00* (2006.01)
*B21C 37/30* (2006.01)
(Continued)

(52) U.S. Cl.
CPC ..... *B21K 23/00* (2013.01); *B21C 37/30* (2013.01); *B21D 22/30* (2013.01); *B21D 53/26* (2013.01); *B21K 23/04* (2013.01)

(58) Field of Classification Search
CPC ..... B21K 23/00; B21K 23/04; B21C 37/30; B21D 22/30; B21D 22/21; B21D 53/26
See application file for complete search history.

(56) References Cited

U.S. PATENT DOCUMENTS 4,739,644 A * 4/1988 Maki ..... B21K 1/30 29/893.34
5,329,799 A 7/1994 Ito et al.
(Continued)

FOREIGN PATENT DOCUMENTS

JP 62-174724 U 11/1987
JP 5-329558 A 12/1993
(Continued)

OTHER PUBLICATIONS

International Preliminary Report on Patentability, issued in PCT/JP2013/084846, prepared on Jun. 19, 2014.
(Continued)

*Primary Examiner* — Teresa M Ekiert
(74) *Attorney, Agent, or Firm* — Birch, Stewart, Kolasch & Birch, LLP

(57) ABSTRACT

An inner punch (11), an outer punch (12), and a die (13) are disposed on the same center axis (10). The outer punch (12) is disposed so as to be apart from the inner punch (11) in a radial direction perpendicular to the center axis (10) by a first space S1 which is larger than a plate thickness T of a cup longitudinal wall portion (A2). Further, an inner peripheral surface of the outer punch (12) has, on its die (13) side, a punch shoulder R portion (12A) widening as it goes toward the die (13). A cup bottom portion (A15) is sandwiched by the inner punch (11) and the die (13) while an outer peripheral surface of the inner punch (11) and an inner peripheral surface of the cup longitudinal wall portion (A2) are apart from each other by a second space S2, and drawing to radially reduce the cup longitudinal wall portion (A2) is performed by pushing the cup longitudinal wall portion (A2) toward the outer peripheral surface of the inner punch (11) by the outer punch (12) while making the outer punch (12) abut on the cup longitudinal wall portion (A2) from the punch shoulder portion (12A), whereby a surplus material is made to flow into a cup shoulder portion (A1) to thicken the cup shoulder portion (A1).

19 Claims, 11 Drawing Sheets

(51) Int. Cl.

| | |
|---|---|
| ***B21D 22/30*** | (2006.01) |
| ***B21D 53/26*** | (2006.01) |
| ***B21K 23/04*** | (2006.01) |

(56) References Cited

U.S. PATENT DOCUMENTS

| | | | | |
|---|---|---|---|---|
| 5,924,188 | A | 7/1999 | Tokunou et al. | |
| 7,624,611 | B2 * | 12/2009 | Saitou | B21D 22/20 72/348 |

FOREIGN PATENT DOCUMENTS

| | | | |
|---|---|---|---|
| JP | 5-329559 | A | 12/1993 |
| JP | 7-124657 | A | 5/1995 |
| JP | 7-155855 | A | 6/1995 |
| JP | 8-309469 | A | 11/1996 |
| JP | 9-295088 | A | 11/1997 |
| JP | 2001-38423 | A | 2/2001 |
| JP | 2001-47175 | A | 2/2001 |
| JP | 2006-289400 | A | 10/2006 |
| JP | 2007-289989 | A | 11/2007 |

OTHER PUBLICATIONS

International Search Report, issued in PCT/JP2013/084846, dated Mar. 4, 2014.

Written Opinion of the International Searching Authority, issued in PCT/JP2013/084846, dated Mar. 4, 2014.

Chinese Office Action and Search Report dated May 6, 2015, for Chinese Application No. 201380012031.2, with a Summary of the Office Action.

Translation of the International Preliminary Report on Patentability dated Jul. 9, 2015, for International Application No. PCT/JP2013/084846.

* cited by examiner

PRESS FORMING METHOD

TECHNICAL FIELD

The present invention relates to a press forming method used for a workpiece formed in a cup shape.

BACKGROUND ART

As parts used for transmissions and so on of vehicles, an axisymmetric part having a cup longitudinal wall portion and a cup bottom wall portion has been known. Using ordinary drawing in order to obtain the axisymmetric part in a cup shape results in thinning of a cup shoulder portion which abuts on a shoulder R portion of a drawing punch. In order to avoid and improve this, there have conventionally been used forging, upsetting which pushes a cup upper end portion (Patent Literature 1), rolling (Patent Literature 2), ironing (Patent Literatures 3, 4), and the like.

CITATION LIST

Patent Literature

Patent Literature 1: Japanese Laid-open Patent Publication No. 2001-47175

Patent Literature 2: Japanese Laid-open Patent Publication No. 2007-289989

Patent Literature 3: Japanese Laid-open Patent Publication No. 05-329558

Patent Literature 4: Japanese Laid-open Patent Publication No. 07-155855

Patent Literature 5: Japanese Laid-open Patent Publication No. 07-124657

SUMMARY OF INVENTION

Technical Problem

However, in the conventional forging method and upsetting method which suppress the thinning of the cup shoulder portion, a forming load is large and a large forming device has been accordingly essential. In the conventional rolling method which suppresses the thinning of the cup shoulder portion, the thinning of the cup longitudinal wall portion has been basically essential. Methods for suppressing the thinning of the cup shoulder portion further include a method of thickening the cup shoulder portion by applying ironing to a workpiece which has been formed into a cup shape and whose cup shoulder portion has been reduced.

FIG. 16 to FIG. 18 are explanatory views of the conventional ironing method which thickens a cup shoulder portion A1.

In the conventional ironing method which thickens the cup shoulder portion A1, in a press forming device, an inner punch 101 is first moved down relatively to a cup-shaped workpiece A placed on a die 103 so that an outer peripheral surface of the inner punch 101 comes into contact with an inner peripheral surface A22 of the workpiece A, whereby the workpiece A is sandwiched by the inner punch 101 and the die 103.

Here, an outer punch 102 has a smaller inside diameter than an outside diameter of the workpiece A. As illustrated in FIG. 17 and FIG. 18, the outer punch 102 is moved down to thin a cup longitudinal wall portion A2 of the workpiece A and an amount by which its thickness is reduced is filled in the cup shoulder portion A1 to thicken the cup shoulder portion A1.

However, the conventional ironing method has a problem that, though the cup shoulder portion A1 can be thickened, the cup longitudinal wall portion A2 is accordingly thinned.

Further, as a forming method for thickening a base end portion of a boss portion of a workpiece having a flat plate portion and the hollow boss portion formed by burring, Patent Literature 5 discloses one in which a punch having a tapered portion is press-fitted from a tip side of the boss portion and is pressed toward the base end portion while the tip side of the boss portion is radially widened by the tapered portion, but its target is not a cup-shaped workpiece.

It is an object of the present invention to provide a press forming method capable of thickening a cup shoulder portion while reducing a forming load without thinning a cup longitudinal wall portion.

Solution to Problem

The gist of the present invention for solving the aforesaid problem is as follows.

(1) A press forming method which applies press forming to a cup-shaped workpiece having a cup longitudinal wall portion, a cup bottom portion, and a cup shoulder portion connecting the cup longitudinal wall portion and the cup bottom portion, by using a press forming device, wherein the press forming device includes an inner punch, an annular outer punch, and a die whose center axes are disposed on the same axis, the outer punch being disposed so as to be apart from the inner punch in a radial direction perpendicular to the center axis by a first space which is larger than a plate thickness of the cup longitudinal wall portion, and the die being disposed to face the inner punch in a direction of the center axis, and an inner peripheral surface of the outer punch has, on a side thereof closer to the die in terms of the center axis direction, a punch shoulder portion widening as the punch shoulder portion goes toward the die, the method including:

a first step of sandwiching the cup bottom portion by the inner punch and the die while an outer peripheral surface of the inner punch and an inner peripheral surface of the cup longitudinal wall portion are apart from each other by a second space; and a second step of performing drawing to radially reduce the cup longitudinal wall portion by pushing the cup longitudinal wall portion toward the outer peripheral surface of the inner punch by the outer punch while moving the outer punch relatively to the inner punch and the die along the center axis to make the outer punch abut on the cup longitudinal wall portion from the punch shoulder portion, thereby making a surplus material of the workpiece flow into the cup shoulder portion to thicken the cup shoulder portion.

(2) The press forming method according to (1), wherein, in the second step, the cup longitudinal wall portion is radially reduced until reaching a position where an outside diameter of an outer peripheral surface of the cup longitudinal wall portion becomes equal to an outside diameter of the die.

(3) The press forming method according to (1) or (2), wherein the cup shoulder portion is formed into a right-angled shape.

(4) The press forming method according to (1), wherein, when the thickening is completed in the second step, a space is formed between the inner peripheral surface portion, of the outer punch, which is in contact with the cup shoulder portion and an outer peripheral surface portion, of the die, which faces the inner peripheral surface portion in the radial direction.

(5) The press forming method according to (4), wherein, in the second step, an outer peripheral surface of the cup shoulder portion is formed so as to be flush with an outer peripheral surface of the cup longitudinal wall portion, by the inner peripheral surface of the outer punch, and on a bottom surface outer edge portion of the cup bottom portion, a surplus portion projecting from the bottom surface is formed by the surplus material made to escape to the space.

(6) The press forming method according to any one of (1) to (5), wherein the punch shoulder portion has a rounded shape or a tapered shape widening as the punch shoulder portion goes toward the die.

(7) The press forming method according to any one of (1) to (6), wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

Advantageous Effects of Invention

According to the present invention, it is possible to provide a press forming method capable of thickening a cup shoulder portion while reducing a forming load, without thinning a cup longitudinal wall portion.

DESCRIPTION OF EMBODIMENTS

Hereinafter, modes for carrying out the present invention will be described with reference to the attached drawings.

(First Embodiment)

Figure 1:
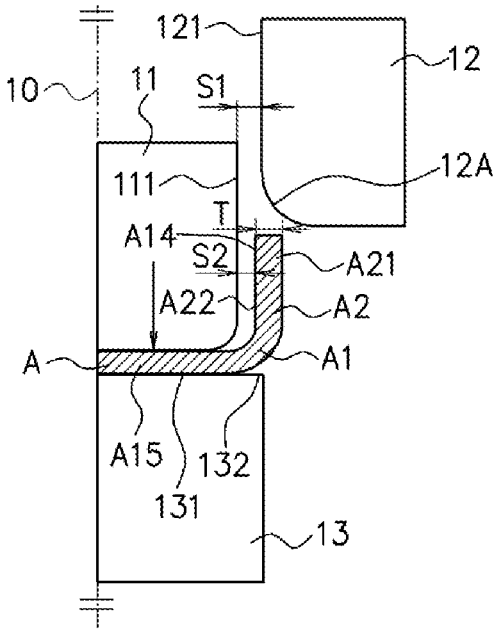
FIG. 1 is a schematic structural view of a press forming device of a first embodiment.

FIG. 1 is a schematic structural view of a press forming device of a first embodiment.

In this embodiment, after a pressing step of press-forming a disk-shaped workpiece into a workpiece A having a cup shape (hereinafter, referred to as a cup-shaped workpiece A) is executed, a thickening step of thickening a cup shoulder portion A1 of the cup-shaped workpiece A is executed. By the pressing step, the cup-shaped workpiece A is formed into a bottomed cylindrical shape having a cup longitudinal wall portion A2 whose one end side forms a cup opening portion A14, a cup bottom portion A15, and the cup shoulder portion A1 in a rounded shape connecting the other end side of the cup longitudinal wall portion A2 and the cup bottom portion A15.

The press forming device of the first embodiment has an inner punch 11, an outer punch 12, and a die 13. The inner punch 11, the outer punch 12, and the die 13 are disposed on the same center axis 10. The inner punch 11 and the outer punch 12 are each capable of independently moving up and down.

The outer punch 12 is formed in an annular shape whose inside diameter is larger than an outside diameter of the inner punch 11. The outer punch 12 is disposed so as to be apart from the inner punch 11 in a radial direction perpendicular to the center axis 10 by a first space S1. The first space S1 is set larger than a plate thickness T of the cup longitudinal wall portion A2.

Further, the outer punch 12 is disposed at a position where it overlaps with a thick portion of the cup longitudinal wall portion A2 in the radial direction. An inner peripheral surface 121 of the outer punch 12 has, on its lower end side (die 13 side) in terms of a direction of the center axis 10, a punch shoulder R portion 12A widening as it goes downward (in a punching direction to the cup longitudinal wall portion A2). The inside diameter of the outer punch 12 is practically equal to an outside diameter of the die 13 (a case where it is slightly larger than the outside diameter of the die 13 is included). By moving down, the outer punch 12 radially reduces the cup longitudinal wall portion A2 until the cup longitudinal wall portion A2 reaches a position where an outside diameter of an outer peripheral surface 21A of the cup longitudinal wall portion A2 becomes equal to the outside diameter of the die 13, which will be described in detail later.

The inner punch 11 is formed in a columnar shape whose outside diameter is smaller than an inside diameter of the cup-shaped workpiece A. The inner punch 11 is disposed to face the die 13 in an up and down direction (direction of the center axis 10), with an outer peripheral surface 111 of the inner punch 11 being apart in the radial direction from an inner peripheral surface A22 of the cup longitudinal wall portion A2 by a second space S2. In this embodiment, the first space S1 between the outer punch 12 and the inner punch 11 and the second space S2 between the inner punch 11 and the cup longitudinal wall portion A2 are set to sizes allowing the cup longitudinal wall portion A2 to abut on the outer peripheral surface 111 of the inner punch 11 and ensuring the forming of the cup longitudinal wall portion A2 along the direction of the center axis 10 at the time of the later-described radial reduction of the cup longitudinal wall portion A2. However, the cup longitudinal wall portion A2 does not necessarily have to abut on the outer peripheral surface 111 of the inner punch 11 at the time of the radial reduction of the cup longitudinal wall portion A2. For example, the first space S1 and the second space S2 may be set to such sizes that the outer peripheral surface 111 of the inner punch 11 is located at a position very much closer to the center axis 10, that is, that the cup longitudinal wall portion A2 does not abut on the outer peripheral surface 111 of the inner punch 11 at the time of the radial reduction of the cup longitudinal wall portion A2.

The die 13 has a columnar shape. An outside diameter of an abutting surface 131, of the die 13, which abuts on the cup bottom portion A15 is larger than the outside diameter of the inner punch 11 and is practically equal to the inside diameter of the outer punch 12 (a case where it is slightly smaller than the inside diameter of the outer punch 12 is included). Consequently, when the thickening of the cup shoulder portion A1 performed by moving down the outer punch 12 is completed, an outer edge portion 132 of the abutting surface 131 and an inner peripheral surface portion 122 (FIG. 3) of the outer punch 12 located on a radially outer side of the outer edge portion 132 are located close to each other to prevent a material forming the cup shoulder portion A1 from flowing into a gap therebetween, which will be described later.

Hereinafter, a forming operation (press forming method) of the press forming device will be described. Referring to FIG. 1, after the cup-shaped workpiece A is placed on the die 13, the inner punch 11 is moved down and the inner punch 11 is inserted into the cup-shaped workpiece A via the cup opening portion A14. While the outer peripheral surface 111 of the inner punch 11 and the inner peripheral surface A22 of the cup longitudinal wall portion A2 are apart from each other by the second space S2, the cup bottom portion A15 is sandwiched by the inner punch 11 and the die 13 (first step). An initial position of the outer punch 12 is above the cup longitudinal wall portion A2.

Figure 2:
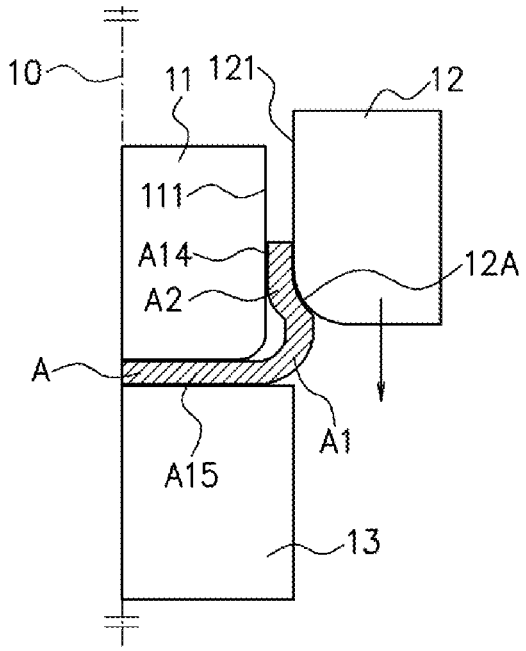
FIG. 2 is a view illustrating an example of a forming state of press forming by the press forming device of the first embodiment.

Next, as illustrated in FIG. 2, the outer punch 12 is moved down and from its punch shoulder R portion 12A, the outer punch 12 is made to abut on the cup longitudinal wall portion A2. Then, the punch shoulder R portion 12A and the inner peripheral surface 121 of the outer punch 12 push the cup longitudinal wall portion A2 in order of the cup opening portion A14 side to the cup bottom portion A15 side, toward the outer peripheral surface 111 of the inner punch 11 to radially reduce the cup longitudinal wall portion A2, whereby the cup longitudinal wall portion A2 is subjected to drawing (second step).

Figure 3:
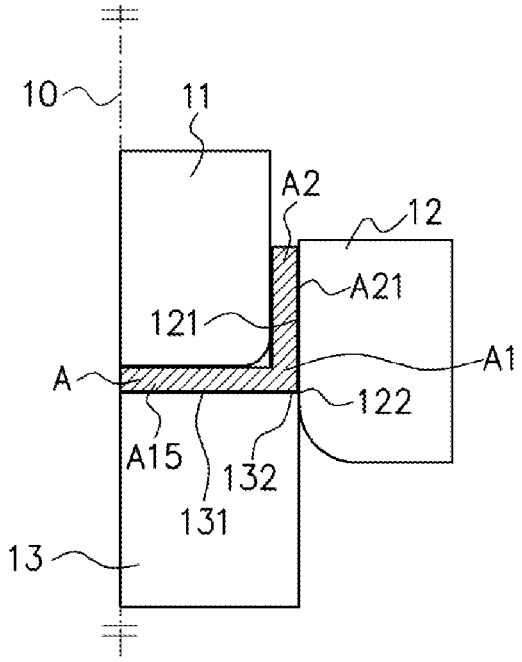
FIG. 3 is a view illustrating an example of a forming completion state of the press forming by the press forming device of the first embodiment.

When the cup longitudinal wall portion A2 is pressed by the outer punch 12, the material of the cup longitudinal wall portion A2 moves toward the outer peripheral surface 111 of the inner punch 11. At this time, a diameter of the cup longitudinal wall portion A2 becomes smaller, and accordingly a surplus material occurs in the material. Since the first space S1 between the inner punch 11 and the outer punch 12 is larger than the plate thickness T before the radial reduction, the surplus material thickens the cup longitudinal wall portion A2. Of the surplus material, a portion which becomes surplus even after the thickening of the cup longitudinal wall portion A2 is led downward by the outer punch 12. Such a phenomenon continuously occurs at the time of the drawing of the cup longitudinal wall portion A2, and therefore, when the outer punch 12 is moved down to a side of the cup bottom portion A15 to apply the drawing to the cup longitudinal wall portion A2, the portion which becomes surplus even after the thickening of the cup longitudinal wall portion A2, of the surplus material of the cup longitudinal wall portion A2 occurring by the drawing, finally thickens the cup shoulder portion A1 as illustrated in FIG. 3. Thus, in this embodiment, the surplus material of the cup longitudinal wall portion A2 occurring by the drawing contributes to the thickening of the cup longitudinal wall portion A2 and the cup shoulder portion A1, which makes it possible to thicken the cup shoulder portion A1 without thinning the cup longitudinal wall portion A2.

Further, at this time, by moving down the outer punch 12, the cup longitudinal wall portion A2 is radially reduced until it reaches the position where the outside diameter of the outer peripheral surface A21 of the cup longitudinal wall portion A2 becomes equal to the outside diameter of the die 13 since the inside diameter of the outer punch 12 and the outside diameter of the die 13 have practically the same size. Further, the outside diameter of the abutting surface 131 of the die 13 and a diameter of the inner peripheral surface 121 of the outer punch 12 have practically the same size, and therefore, at the completion of the thickening of the cup shoulder portion A2, the outer edge portion 132 of the abutting surface 131 and the inner peripheral surface portion 122, of the outer punch 12, which is located on the radially outer side of the outer edge portion 132 are located at positions close to each other, which prevents the material forming the cup shoulder portion A1 from flowing into a gap therebetween Consequently, when an amount of the thickening material flowing into the cup shoulder portion A1 is sufficient, the cup shoulder portion A1 is formed into a right-angled shape in a view taken along an axial direction of the cup-shaped workpiece A.

As described above, in this embodiment, since the thickening of the cup shoulder portion A1 is performed by the drawing of the cup longitudinal wall portion A2, it is possible to thicken the cup shoulder portion A1 while reducing a forming load. Further, since the drawing is performed while the space S1 between the outer punch 12 and the inner punch 11 is set equal to or more than the thickness T of the cup longitudinal wall portion A2, the cup longitudinal wall portion A2 is not thinned.

Further, in the conventional forging method and upsetting method, when an attempt is made to form the cup shoulder portion A1 into the same right-angled shape as that of a die shape, the forming load reaches several thousand tons. On the other hand, in the press forming method of this embodiment, the cup shoulder portion A1 is thickened by the drawing, and therefore, even when the cup shoulder portion A1 is formed into the right-angled shape, it is possible to reduce the forming load to about several hundred tons which is smaller than that of the conventional forging method and upsetting method by a single digit.

By setting the outside diameter of the inner punch 11 and the inside diameter of the outer punch 12 still smaller, it is possible to more increase a radial reduction ratio of the cup longitudinal wall portion A2 to more thicken the cup shoulder portion A1.

Incidentally, when the cup-shaped workpiece A is installed on the die 13, a center axis of the cup-shaped workpiece A may be aligned with the center axis 10, but the center axis of the cup-shaped workpiece A may be deviated from the center axis 10 within a range allowing the inner punch 11 to move down to a region on a more radially inner side than the cup longitudinal wall portion A2. In this case, the outer punch 12 is moved down while the cup-shaped workpiece A is sandwiched by the inner punch 11 and the die 13 with a force allowing the cup-shaped workpiece A to displace in the radial direction. At this time, since the punch shoulder R portion 12A of the outer punch 12 abuts on the annular cup longitudinal wall portion A2 in a biased state, the cup-shaped workpiece A displaces, so that the center axis of the cup-shaped workpiece A coincides with the center axis 10. After the center axis of the cup-shaped workpiece A coincides with the center axis 10, the cup-shaped workpiece A is sandwiched by the inner punch 11 and the die 13 and the outer punch 12 is further moved down.

Figure 4:
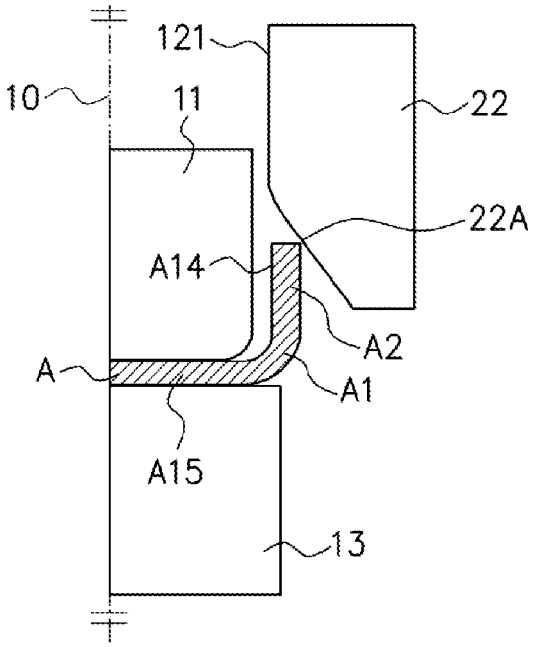
FIG. 4 is a view illustrating another plan of the press forming device of the first embodiment.

Further, preferably, the punch shoulder portion of the outer punch 12 is the punch shoulder R portion 12A which widens as it goes in the punching direction of the outer punch 12 to the cup longitudinal wall portion A2, or is a tapered portion 22A which widens as it goes in the punching direction as in an outer punch 22 illustrated in FIG. 4. Thus structuring the punch shoulder portions of the outer punch 12, 22 makes it possible to radially reduce the cup longitudinal wall portion A2 gently and continuously in order of its cup opening portion A14 side to its cup bottom portion A15 side, and also enables a reduction of a contact angle of the cup longitudinal wall portion A2 and each of the outer punches 12, 22, which makes it possible to reduce a contact reaction force in the vertical direction to reduce a frictional force of each of the outer punches 12, 22 with the cup longitudinal wall portion A2. Accordingly, a forming force in a vertically downward direction to a portion near the cup bottom portion A15 in the cup longitudinal wall portion A2 and to the cup shoulder portion A1 can be made smaller than that of the conventional ironing, which can suppress the occurrence of inward folding in the cup shoulder portion A1.

(Second Embodiment)

Figure 5:
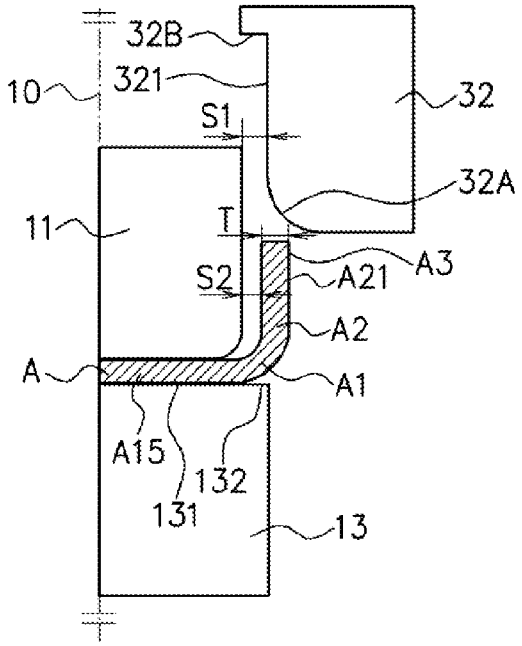
FIG. 5 is a schematic structural view of a press forming device of a second embodiment.

FIG. 5 is a schematic structural view of a press forming device of a second embodiment.

The press forming device of this embodiment differs from that of the first embodiment only in a shape of an outer punch 32, and what are different from the first embodiment will be described below.

In this embodiment, on an inner peripheral surface 321 of the outer punch 32, an end surface pushing portion 32B in a circumferential shape projecting in a radial direction from the whole circumference of the inner peripheral surface 321 is formed. The end surface pushing portion 32B is disposed at a position where the inner peripheral surface 321 becomes longer than the whole height of a cup-shaped workpiece A.

Figure 6:
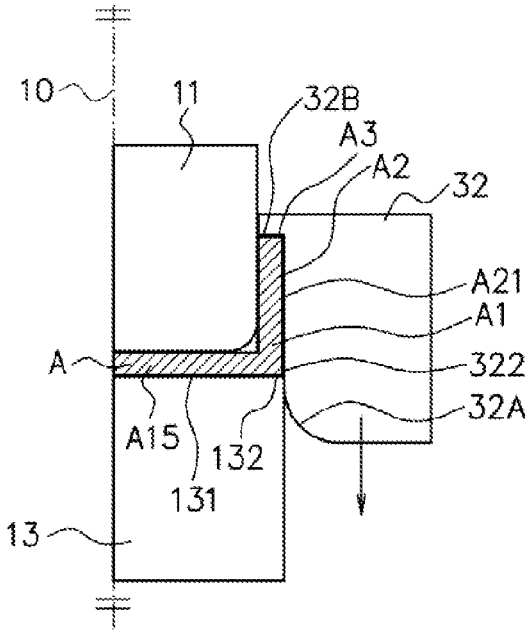
FIG. 6 is a view illustrating an example of a forming completion state of press forming by the press forming device of the second embodiment.

A press forming method of this embodiment is different from that of the first embodiment in that, in a second step of drawing a cup longitudinal wall portion A2 by moving down the outer punch 32, at the time of thickening forming of a cup shoulder portion A1, a cup upper end portion A3 of the cup-shaped workpiece A is pushed in by using the end surface pushing portion 32B of the outer punch 32, as illustrated in FIG. 6. Consequently, in this embodiment, it is possible to improve accuracy of the transfer of a die shape to the cup shoulder portion A1 and the cup longitudinal wall portion A2.

Incidentally, in a press forming method of this embodiment, a forming condition is close to that of closed die forging, so that a forming load increases. Therefore, it is preferable that a volume V1 of the cup-shaped workpiece A and a volume V2 of a vacant portion formed by an inner punch 11, the outer punch 32, and a die 13 satisfy a relation of $V1<V2$.

(Modification Examples)

Figure 7A:
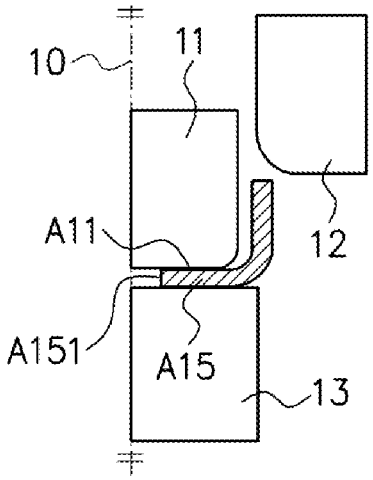
FIG. 7A is a view illustrating an example of a cup-shaped workpiece to which the present invention is applicable.
Figure 7B:
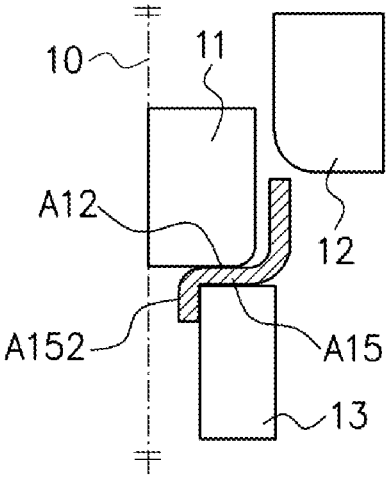
FIG. 7B is a view illustrating an example of the cup-shaped workpiece to which the present invention is applicable.
Figure 7C:
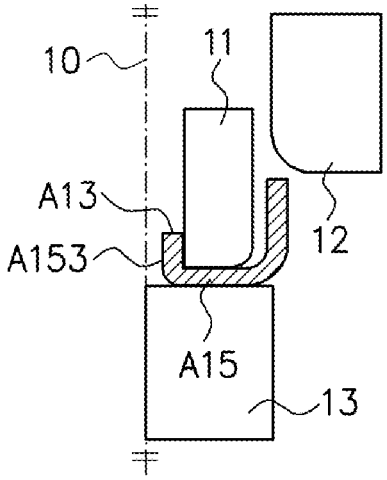
FIG. 7C is a view illustrating an example of the cup-shaped workpiece to which the present invention is applicable.

FIG. 7A to FIG. 7C are views illustrating examples of the cup-shaped workpiece to which the press forming method of the present invention is applicable.

As the shape of the cup-shaped workpiece to which the press forming method of the present invention is applicable, not only the simple bottomed cylindrical shape illustrated in the first and second embodiments but also appropriate ones are usable. For example, as illustrated in FIG. 7A, a perforated cup-shaped workpiece A11 having a hole A151 in a cup bottom portion A15 may be used. Further, as illustrated in FIG. 7B, a cup-shaped workpiece A12 with boss on whose cup bottom portion A15 a boss A152 projecting outward is formed may be used, or as illustrated in FIG. 7C, a cup-shaped workpiece A13 with boss on whose cup bottom portion A15 a boss A153 projecting inward is formed may be used.

Further, as a material of the cup-shaped workpiece to which the press forming method of the present invention is applicable, various well-known ones which can be plastically worked, such as metals such as steel, aluminum, and copper or alloys of these, and so on can be adopted.

In the second step of the first and second embodiments, the cup shoulder portion A1 is thickened by moving the outer punch 12 (22, 32) toward the inner punch 11, the die 13, and the cup-shaped workpiece A, but the cup shoulder portion A1 may be thickened by moving the inner punch 11, the die 13, and the cup-shaped workpiece A toward the outer punch (22, 32).

Further, the first and second embodiments describe the examples where the inner punch 11 and the outer punch 12 (22, 32) are above the die 13, but the positions of the inner punch 11 and the outer punch 12 (22, 32) and the position of the die 13 may be vertically reversed.

(Third Embodiment)

Figure 8:
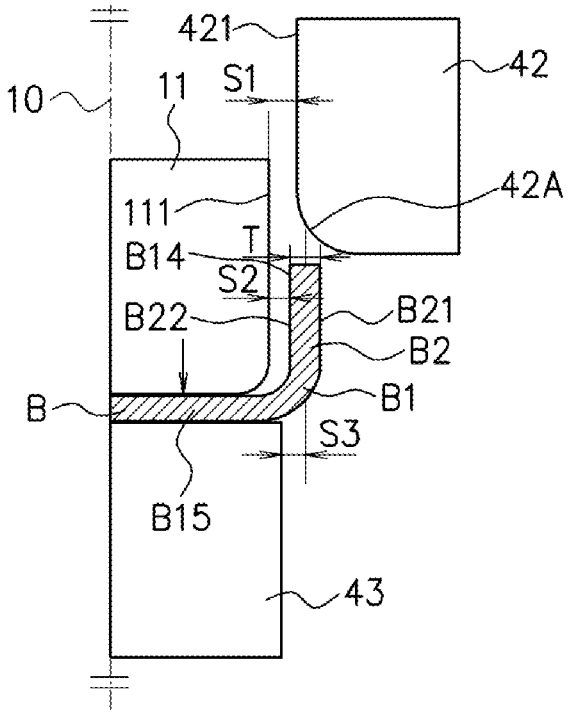
FIG. 8 is a schematic structural view of a press forming device of a third embodiment.

FIG. 8 is a schematic structural view of a press forming device of a third embodiment.

In this embodiment, after a pressing step of press-forming a disk-shaped workpiece into a workpiece B having a cup shape (hereinafter, referred to as a cup-shaped workpiece B) is executed, a thickening step of thickening a cup shoulder portion B1 of the cup-shaped workpiece B is executed. By the pressing step, the cup-shaped workpiece B is formed into a bottomed cylindrical shape having a cup longitudinal wall portion B2 whose one end side forms a cup opening portion B14, a cup bottom portion B15, and the cup shoulder portion B1 in a rounded shape connecting the other end side of the cup longitudinal wall portion B2 and the cup bottom portion B15.

The press forming device of the third embodiment has an inner punch 11, an outer punch 42, and a die 43. The inner punch 11, the outer punch 42, and the die 43 are disposed on the same center axis 10. The inner punch 11 and the outer punch 42 are each capable of independently moving up and down.

The outer punch 42 is formed in an annular shape whose inside diameter is larger than an outside diameter of the inner punch 11. The outer punch 42 is disposed so as to be apart from the inner punch 11 in a radial direction perpendicular to the center axis 10 by a first space S1. The first space S1 is set larger than a plate thickness T of the cup longitudinal wall portion B2.

Further, the outer punch 42 is disposed at a position where it overlaps with a thick portion of the cup longitudinal wall portion B2 in the radial direction. An inner peripheral surface 421 of the outer punch 42 has, on its lower end side (die 43 side) in terms of a direction of the center axis 10, a punch shoulder R portion 42A widening as it goes downward (in a punching direction to the cup longitudinal wall portion B2).

The inner punch 11 is formed in a columnar shape whose outside diameter is smaller than an inside diameter of the cup-shaped workpiece B. The inner punch 11 is disposed to face the die 43 in an up and down direction (direction of the center axis 10), with an outer peripheral surface 111 of the inner punch 11 being apart from an inner peripheral surface B22 of the cup longitudinal wall portion B2 in the radial direction by a second space S2. In this embodiment, the first space S1 between the outer punch 42 and the inner punch 11 and the second space S2 between the inner punch 11 and the cup longitudinal wall portion B2 are set to sizes allowing the cup longitudinal wall portion B2 to abut on the outer peripheral surface 111 of the inner punch 11 and ensuring the forming of the cup longitudinal wall portion B2 along the direction of the center axis 10 at the time of later-described radial reduction of the cup longitudinal wall portion B2. However, the cup longitudinal wall portion B2 does not necessarily have to abut on the outer peripheral surface 111 of the inner punch 11 at the time of the radial reduction of the cup longitudinal wall portion B2. For example, the first space S1 and the second space S2 may be set to such sizes that the outer peripheral surface 111 of the inner punch 11 is located at a position very much closer to the center axis 10, that is, that the cup longitudinal wall portion B2 does not abut on the outer peripheral surface 111 of the inner punch 11 at the time of the radial reduction of the cup longitudinal wall portion B2.

The die 43 has a columnar shape and its outside diameter is larger than the outside diameter of the inner punch 11 and is smaller than the inside diameter of the outer punch 42. The die 43 may have an outside diameter practically equal to the outside diameter of the inner punch 11, but when it is larger than the outside diameter of the inner punch 11, it is possible to keep the cup bottom portion B15 flatter through a later-described press forming step of the cup-shaped workpiece B. Because the outside diameter of the die 43 is smaller than the inside diameter of the outer punch 42, when the outer punch 42 moves down to thicken the cup shoulder portion B1 of the cup-shaped workpiece B, an escape space S3, which will be described later, is formed between an inner peripheral surface portion 422 (FIG. 10), of the outer punch 42, which is in contact with the cup shoulder portion B1 and an outer peripheral surface portion 431 (FIG. 10), of the die 43, which faces the inner peripheral surface portion 422 in the radial direction.

Hereinafter, a forming operation (press forming method) of the press forming device will be described. Referring to FIG. 8, after the cup-shaped workpiece B is placed on the die 43, the inner punch 11 is moved down and the inner punch 11 is inserted into the cup-shaped workpiece B via the cup opening portion B14. While the outer peripheral surface 111 of the inner punch 11 and the inner peripheral surface B22 of the cup longitudinal wall portion B2 are apart from each other by the second space S2, the cup bottom portion B15 is sandwiched by the inner punch 11 and the die 43 (first step). An initial position of the outer punch 42 is above the cup longitudinal wall portion B2.

Figure 9:
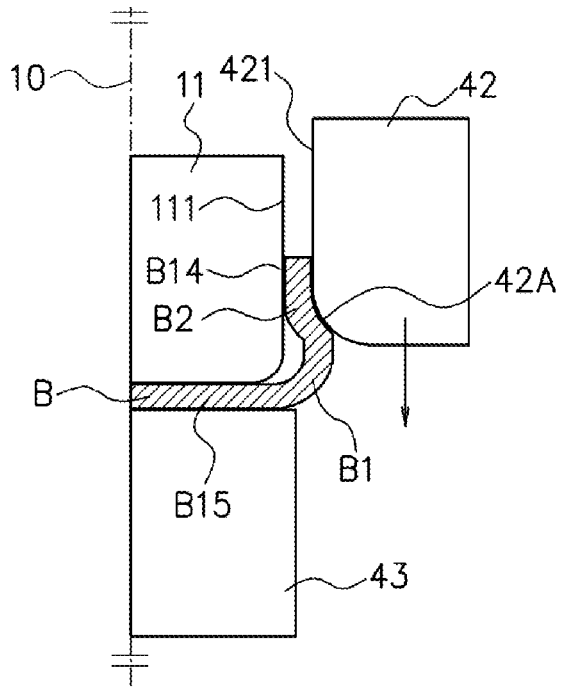
FIG. 9 is a view illustrating an example of a forming state of press forming by the press forming device of the third embodiment.

Next, as illustrated in FIG. 9, the outer punch 42 is moved down, and from the punch shoulder R portion 42A, the outer punch 42 is made to abut on the cup longitudinal wall portion B2. Then, the punch shoulder R portion 42A and the inner peripheral surface 421 of the outer punch 42 push the cup longitudinal wall portion B2 in order of its cup opening portion B14 side to its cup bottom B15 side, toward the outer peripheral surface 111 of the inner punch 11 to radially reduce the cup longitudinal wall portion B2, whereby the cup longitudinal wall portion B2 is subjected to drawing (second step).

Figure 10:
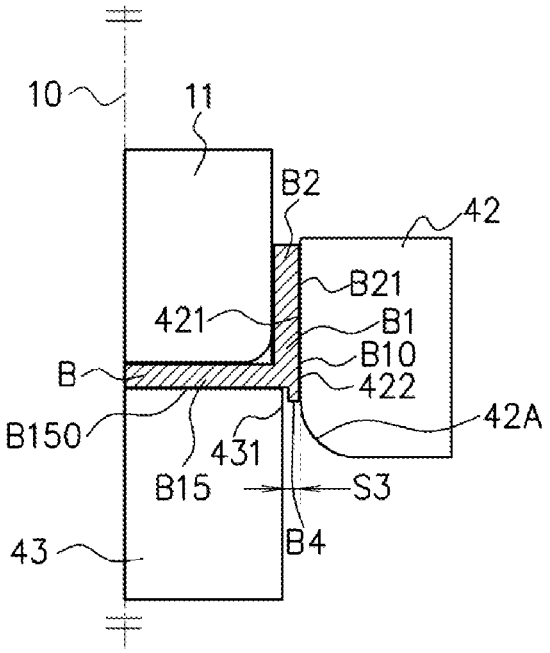
FIG. 10 is a view illustrating an example of a forming completion state of press forming by the press forming device of the third embodiment.

When the cup longitudinal wall portion B2 is pressed by the outer punch 42, the material of the cup longitudinal wall portion B2 moves toward the outer peripheral surface 111 of the inner punch 11. At this time, a diameter of the cup longitudinal wall portion B2 becomes smaller, and accordingly a surplus material occurs in the material. Since the first space S1 between the inner punch 11 and the outer punch 42 is larger than the plate thickness T before the radial reduction, the surplus material thickens the cup longitudinal wall portion B2. Of the surplus material, a portion which becomes surplus even after the thickening of the cup longitudinal wall portion B2 is led downward by the outer punch 42. Such a phenomenon continuously occurs at the time of the drawing of the cup longitudinal wall portion B2, and therefore, when the outer punch 42 is moved down to a side of the cup bottom portion B15 to apply the drawing to the cup longitudinal wall portion B2, the portion which becomes surplus even after the thickening of the cup longitudinal wall portion B2, of the surplus material of the cup longitudinal wall portion B2 occurring by the drawing, finally thickens the cup shoulder portion B1 as illustrated in FIG. 10. Thus, in this embodiment, the surplus material of the cup longitudinal wall portion B2 occurring by the drawing contributes to the thickening of the cup longitudinal wall portion B2 and the cup shoulder portion B1, which makes it possible to thicken the cup shoulder portion B1 without thinning the cup longitudinal wall portion B2.

In this case, by adjusting the thickness T of the cup longitudinal wall portion B2 or sizes of the spaces S1 to 3, it is possible to make the thickening material of the cup longitudinal wall portion B2 sufficiently flow into the cup shoulder portion B1, and an outer peripheral surface B10 of the cup shoulder portion B1 can be formed so as to be flush with an outer peripheral surface B21 of the cup longitudinal wall portion B2 by the inner peripheral surface 421 of the outer punch 42. Consequently, the cup shoulder portion B1 can be formed in a right-angled shape. At this time, between the inner peripheral surface portion 422, of the outer punch 42, which is in contact with the cup shoulder portion B1 and the outer peripheral surface portion 431, of the die 43, which faces the inner peripheral surface portion 422 in the radial direction, the escape space S3 is formed. Consequently, when the surplus material occurs in the thickening material of the cup shoulder portion B1, it is possible to make the surplus material escape to the escape space S3. On an outer edge portion of the bottom surface B150 of the cup bottom portion B15, a surplus portion B4 projecting from a bottom surface B150 is formed by the surplus material escaping to the escape space S3.

As described above, in this embodiment, since the thickening of the cup shoulder portion B1 is performed by the drawing of the cup longitudinal wall portion B2, it is possible to thicken the cup shoulder portion B1 while reducing a forming load. Further, since the drawing is performed while the space S1 between the outer punch 42 and the inner punch 11 is set equal to or more than the thickness T of the cup longitudinal wall portion B2, the cup longitudinal wall portion B2 is not thinned.

Further, in the conventional forging method and upsetting method, when an attempt is made to form the cup shoulder portion B1 into the same right-angled shape as that of a die shape, the forming load reaches several thousand tons. On the other hand, in the press forming method of this embodiment, the cup shoulder portion B1 is thickened by the drawing, and therefore, even when the cup shoulder portion B1 is formed into the right-angled shape, it is possible to reduce the forming load to about several hundred tons which is smaller than that of the conventional forging method and upsetting method by a single digit.

By setting the outside diameter of the inner punch 11 and the inside diameter of the outer punch 42 still smaller, it is possible to more increase a radial reduction ratio of the cup longitudinal wall portion B2 to more thicken the cup shoulder portion B1.

In the press forming method of this embodiment, when the cup shoulder portion B1 is formed into the right-angled shape, the surplus portion B4 is formed on the outer edge portion of the bottom surface B150 of the cup bottom portion B15 by the surplus material of the cup-shaped workpiece B which material is made to escape to the escape space S3 between the die 43 and the outer punch 42. This necessitates an additional step of removing the surplus portion B4 in a later step, but the size of the surplus portion B4 is generally about several millimeters. Further, when the cup-shaped workpiece B is worked, with its material being changed, since a behavior of the material during the working changes (in this embodiment, since a state of plastic flow of the cup longitudinal wall portion B2 and the cup shoulder portion B1 during the drawing changes), a different die whose dimension is adjusted differently is generally used in many cases. In this embodiment, even when the material of the cup-shaped workpiece B is changed, an amount of the surplus material of the cup-shaped workpiece B which is made to escape to the escape space S3 between the die 43 and the outer punch 42 only changes, which reduces the necessity for changing the die according to the change of the material. Further, since the escape space S3 is provided, a closed die forging state does not structurally occur, which can suppress a rapid increase of the forming load during the forming to reduce tuning for safely operating the press forming device. Therefore, even if the trouble of removing the surplus portion B4 by cutting or the like is taken into consideration, this embodiment can enjoy the merit.

Incidentally, when the cup-shaped workpiece B is installed on the die 43, a center axis of the cup-shaped workpiece B may be aligned with the center axis 10, but the center axis of the cup-shaped workpiece B may be deviated from the center axis 10 within a range allowing the inner punch 11 to move down to a region on a more radially inner side than the cup longitudinal wall portion B2. In this case, the outer punch 12 is moved down while the cup-shaped workpiece B is sandwiched by the inner punch 11 and the die 43 with a force allowing the cup-shaped workpiece B to displace in the radial direction. At this time, since the punch shoulder R portion 42A of the outer punch 42 abuts on the annular cup-shaped longitudinal wall portion B2 in a biased state, the cup-shaped workpiece B displaces, so that the center axis of the cup-shaped workpiece B coincides with the center axis 10. After the center axis of the cup-shaped workpiece B coincides with the center axis 10, the cup-shaped workpiece B is sandwiched by the inner punch 11 and the die 43 and the outer punch 42 is further moved down.

Figure 11:
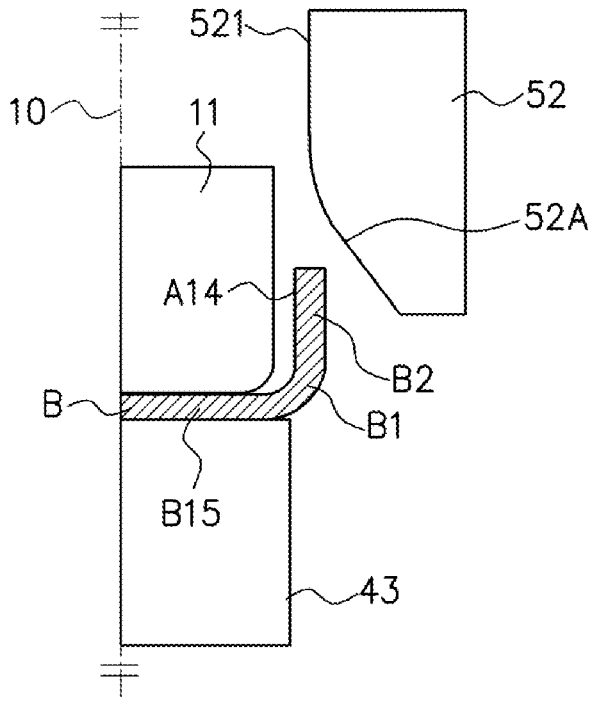
FIG. 11 is a view illustrating another plan of the press forming device of the third embodiment.

Further, preferably, the punch shoulder portion of the outer punch 42 is the punch shoulder portion 42A which widens as it goes in the punching direction of the outer punch 42 to the cup longitudinal wall portion B2, or is a tapered portion 52A which widens as it goes in the punching direction as in an outer punch 52 illustrated in FIG. 11. Thus structuring the punch shoulder portions of the outer punches 42, 52 makes it possible to radially reduce the cup longitudinal wall portion B2 gently and continuously in order of its cup opening portion B14 side to its cup bottom portion A15 side and also enables a reduction of a contact angle of the cup longitudinal wall portion B2 and each of the outer punches 42, 52, which makes it possible to reduce a contact reaction force in a vertical direction to reduce a frictional force of each of the outer punches 42, 52 with the cup longitudinal wall portion B2. Accordingly, a forming force in a vertically downward direction to a portion near the cup bottom portion B15 in the cup longitudinal wall portion B2 and to the cup shoulder portion B1 can be made smaller than that of the conventional ironing, which can suppress the occurrence of inward folding in the cup shoulder portion B1.

(Fourth Embodiment)

Figure 12:
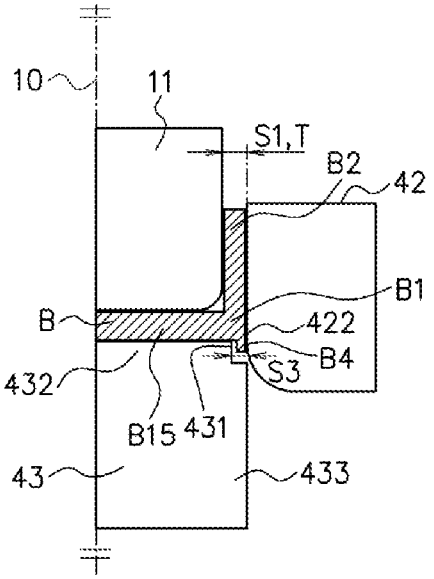
FIG. 12 is a schematic structural view of a press forming device of a fourth embodiment.

FIG. 12 is a schematic structural view of a press forming device of a fourth embodiment.

In the press forming device of this embodiment, a die 43 is formed in a stepped shape whose end portion 432 abutting on a cup bottom portion B15 has a diameter smaller than a diameter of a main body portion 433 of the die 43. The other structure is the same as that of the third embodiment, and hereinafter, what are different from the third embodiment will be mainly described.

In this embodiment as in the third embodiment, at the time of drawing of a cup-shaped workpiece B, an escape space S3 is formed between an inner peripheral surface portion 422, of an outer punch 42, which is in contact with a cup shoulder portion B1 and an outer peripheral surface portion 431, of the die 43, which faces the inner peripheral surface portion 422 in a radial direction. Consequently, when a surplus material occurs in a thickening material flowing into the cup shoulder portion B1, the surplus material can be made to escape to the escape space S3. Therefore, it is possible to thicken the cup shoulder portion B1 while reducing a forming load, without thinning a cup longitudinal wall portion B2.

(Fifth Embodiment)

Figure 13:
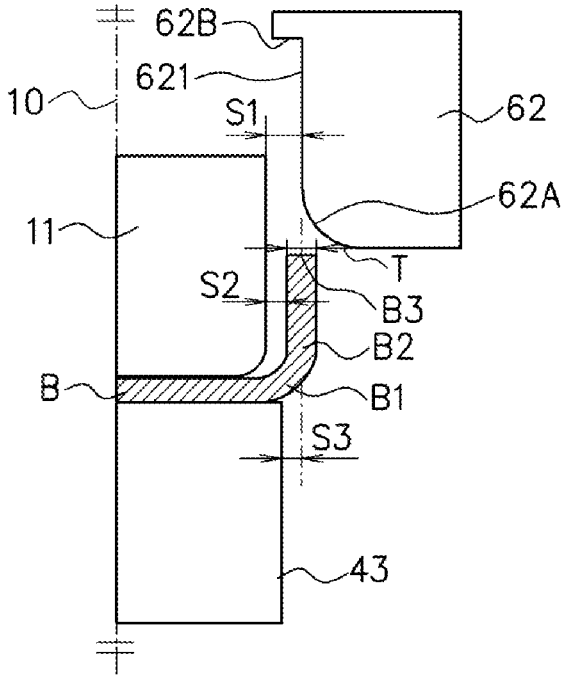
FIG. 13 is a schematic structural view of a press forming device of a fifth embodiment.

FIG. 13 is a schematic structural view of a press forming device of a fifth embodiment.

The press forming device of this embodiment is different from that of the third embodiment only in a shape of an outer punch 62, and what are different from the third embodiment will be mainly described below.

In this embodiment, on an inner peripheral surface 621 of the outer punch 62, an end surface pushing portion 62B in a circumferential shape projecting in a radial direction from the whole circumference of the inner peripheral surface 621 is formed. The end surface pushing portion 62B is disposed at a position where the inner peripheral surface 621 becomes longer than the whole height of a cup-shaped workpiece B.

Figure 14:
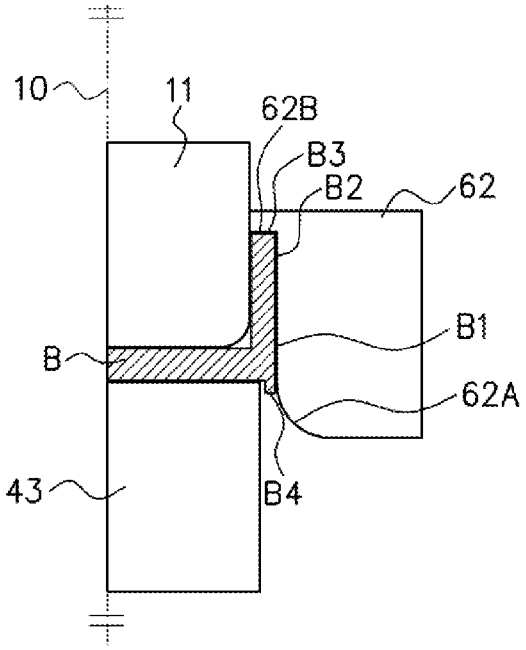
FIG. 14 is a view illustrating an example of a forming completion state of press forming by the press forming device of the fifth embodiment.

A press forming method of this embodiment is different from that of the third embodiment in that, in a second step of drawing a cup longitudinal wall portion B2 by moving down the outer punch 62, at the time of thickening forming of a cup shoulder portion B1, a cup upper end portion B3 of the cup-shaped workpiece B is pushed in by using the end surface pushing portion 62B of the outer punch 62, as illustrated in FIG. 14. Consequently, in this embodiment, it is possible to improve accuracy of the transfer of a die shape to the cup shoulder portion B1 and the cup longitudinal wall portion B2.

(Modification Examples)

Figure 15A:
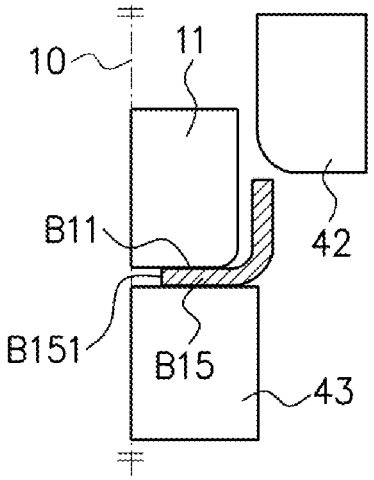
FIG. 15A is a view illustrating an example of a cup-shaped workpiece to which the present invention is applicable.
Figure 15B:
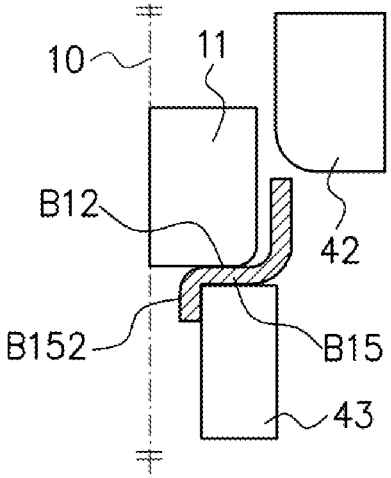
FIG. 15B is a view illustrating an example of the cup-shaped workpiece to which the present invention is applicable.
Figure 15C:
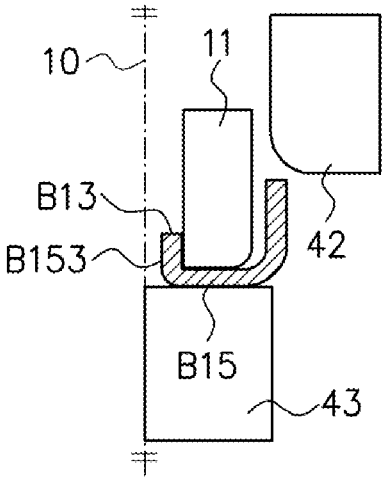
FIG. 15C is a view illustrating an example of the cup-shaped workpiece to which the present invention is applicable.
Figure 16:
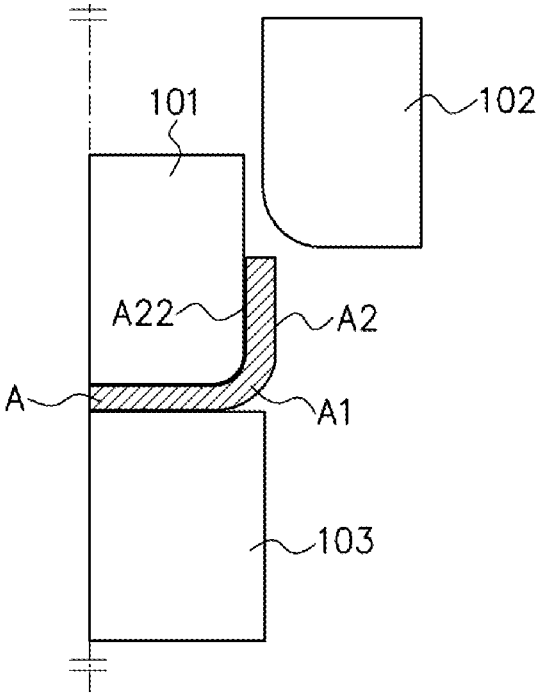
FIG. 16 is an explanatory view of a conventional press forming method of thickening a cup shoulder portion.
Figure 17:
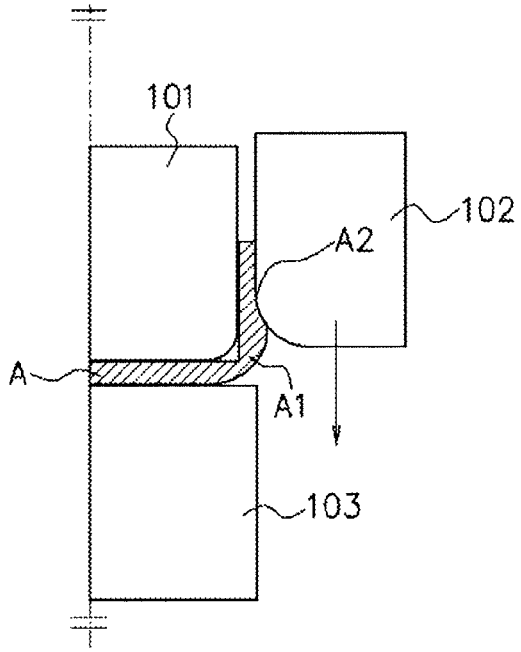
FIG. 17 PRIOR ART
FIG. 17 is a view illustrating an example of a forming state of the conventional press forming method of thickening the cup shoulder portion.
Figure 18:
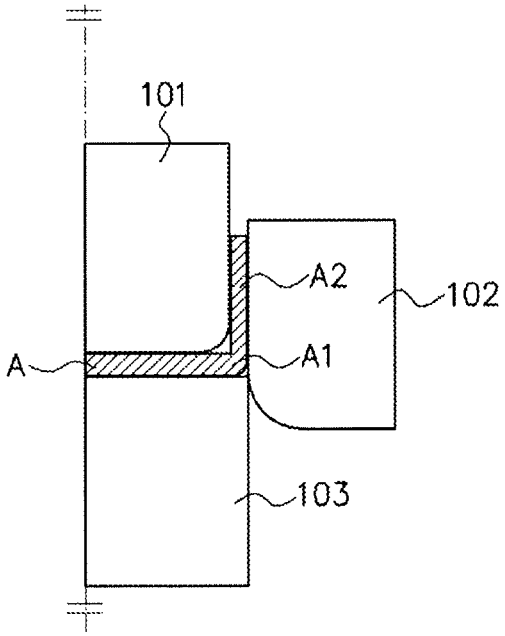
FIG. 18 PRIOR ART
FIG. 18 is a view illustrating an example of a forming completion state of the conventional press forming method of thickening the cup shoulder portion.

FIG. 15A to FIG. 15C are views illustrating examples of the cup-shaped workpiece to which the press forming method of the present invention is applicable.

As the shape of the cup-shaped workpiece to which the press forming method of the present invention is applicable, not only the simple bottomed cylindrical shape illustrated in the third to fifth embodiments but also appropriate ones are usable. For example, as illustrated in FIG. 15A, a perforated cup-shaped workpiece B11 having a hole B151 in a cup bottom portion B15 may be used. Further, as illustrated in FIG. 15B, a cup-shaped workpiece B12 with boss on whose cup bottom portion B15 a boss B152 projecting outward is formed may be used, or as illustrated in FIG. 15C, a cup-shaped workpiece B13 with boss on whose cup bottom portion B15 a boss B153 projecting inward is formed may be used.

Further, as a material of the cup-shaped workpiece to which the press forming method of the present invention is applicable, various well-known ones which can be plastically worked, such as metals such as steel, aluminum, and copper or alloys of these, and so on can be adopted.

In the second step of the third to fifth embodiments, the cup shoulder portion B1 is thickened by moving the outer punch 42 (52, 62) toward the inner punch 11, the die 43, and the cup-shaped workpiece B, but the cup shoulder portion B1 may be thickened by moving the inner punch 11, the die 43, and the cup-shaped workpiece B toward the outer punch 42 (52, 62).

Further, the third to fifth embodiments describe the examples where the inner punch 11 and the outer punch 42 (52, 62) are above the die 43, but the positions of the inner punch 11 and the outer punch 42 (52, 62) and the position of the die 43 may be vertically reversed.

In the foregoing, the present invention is described together with the various embodiments, but the present invention is not limited to these embodiments, and modifications and so on can be made within a range of the present invention.

INDUSTRIAL APPLICABILITY

The present invention is applicable to a press forming method of applying press forming to a cup-shaped workpiece used, for example, for transmissions and so on of vehicles.

The invention claimed is:

1. A press forming method which applies press forming to a cup-shaped workpiece having a cup longitudinal wall portion, a cup bottom portion, and a cup shoulder portion connecting the cup longitudinal wall portion and the cup bottom portion, by using a press forming device, wherein the press forming device includes an inner punch, an annular outer punch, and a die whose center axes are disposed on the same axis, the outer punch being disposed so as to be apart from the inner punch in a radial direction perpendicular to the center axis by a first space which is larger than a plate thickness of the cup longitudinal wall portion, and the die being disposed to face the inner punch in a direction of the center axis, and an inner peripheral surface of the outer punch has, on a side thereof closer to the die in terms of the center axis direction, a punch shoulder portion widening as the punch shoulder portion goes toward the die, the method comprising:

a first step of sandwiching the cup bottom portion by the inner punch and the die while an outer peripheral surface of the inner punch and an inner peripheral surface of the cup longitudinal wall portion are apart from each other by a second space; and a second step of performing drawing to radially reduce the cup longitudinal wall portion by pushing the cup longitudinal wall portion toward the outer peripheral surface of the inner punch by the outer punch while moving the outer punch relatively to the inner punch and the die along the center axis to make the outer punch abut on the cup longitudinal wall portion from the punch shoulder portion, thereby making a surplus material of the workpiece flow into the cup shoulder portion to thicken the cup shoulder portion.

2. The press forming method according to claim 1, wherein, in the second step, the cup longitudinal wall portion is radially reduced until reaching a position where an outside diameter of an outer peripheral surface of the cup longitudinal wall portion becomes equal to an outside diameter of the die.

3. The press forming method according to claim 2, wherein the cup shoulder portion is formed into a right-angled shape.

4. The press forming method according to claim 3, wherein the punch shoulder portion has a rounded shape or a tapered shape widening as the punch shoulder portion goes toward the die.

5. The press forming method according to claim 3, wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

6. The press forming method according to claim 2, wherein the punch shoulder portion has a rounded shape or a tapered shape widening as the punch shoulder portion goes toward the die.

7. The press forming method according to claim 2, wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

8. The press forming method according to claim 1, wherein the cup shoulder portion is formed into a right-angled shape.

9. The press forming method according to claim 8, wherein the punch shoulder portion has a rounded shape or a tapered shape widening as the punch shoulder portion goes toward the die.

10. The press forming method according to claim 8, wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

11. The press forming method according to claim 1, wherein, when the thickening is completed in the second step, a space is formed between the inner peripheral surface portion, of the outer punch, which is in contact with the cup shoulder portion and an outer peripheral surface portion, of the die, which faces the inner peripheral surface portion in the radial direction.

12. The press forming method according to claim 11, wherein, in the second step, an outer peripheral surface of the cup shoulder portion is formed so as to be flush with an outer peripheral surface of the cup longitudinal wall portion, by the inner peripheral surface of the outer punch, and on a bottom surface outer edge portion of the cup bottom portion, a surplus portion projecting from the bottom surface is formed by the surplus material made to escape to the space.

13. The press forming method according to claim 12, wherein the punch shoulder portion has a rounded shape or a tapered shape widening as the punch shoulder portion goes toward the die.

14. The press forming method according to claim 12, wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

15. The press forming method according to claim 11, wherein the punch shoulder portion has a rounded shape or a tapered shape widening as the punch shoulder portion goes toward the die.

16. The press forming method according to claim 11, wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

17. The press forming method according to claim 1, wherein the punch shoulder portion has a rounded shape or a tapered shape widening as the punch shoulder portion goes toward the die.

18. The press forming method according to claim 17, wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

19. The press forming method according to claim 1, wherein:

on the inner peripheral surface of the outer punch, an end surface pushing portion in a circumferential shape projecting in the radial direction from the inner peripheral surface is formed; and in the second step, at the time of thickening the cup shoulder portion by relatively moving the outer punch, the cup longitudinal wall portion is pushed toward the die by the end surface pushing portion.

* * * * *